US005181374A

United States Patent [19]

Aeppli

[11] Patent Number: 5,181,374

[45] Date of Patent: Jan. 26, 1993

[54] METHOD FOR SETTING THE SENSITIVITY LIMITS OF ELECTRONIC YARN CLEARERS, AND DEVICE FOR CARRYING OUT THE METHOD

[75] Inventor: Kurt Aeppli, Uster, Switzerland

[73] Assignee: Zellweger Uster AG, Uster, Switzerland

[21] Appl. No.: 575,800

[22] Filed: Aug. 31, 1990

[30] Foreign Application Priority Data

Aug. 31, 1989 [CH] Switzerland ..... 03154/89

[51] Int. Cl.[5] ..... D01N 13/26; B65H 63/06

[52] U.S. Cl. ..... 57/264; 28/227; 57/265

[58] Field of Search ..... 57/300-306, 57/264, 265; 242/36; 28/227; 73/160; 364/568, 470

[56] References Cited

U.S. PATENT DOCUMENTS

| | | | |
|---|---|---|---|
| 3,264,922 | 8/1966 | Peyer | 28/227 X |
| 3,594,558 | 7/1971 | Loepfe | 28/227 X |
| 3,643,882 | 2/1972 | Grant | 242/36 |
| 3,892,951 | 7/1975 | Stutz | 73/160 X |
| 3,892,952 | 7/1975 | Stutz | 28/227 |
| 3,930,205 | 12/1975 | Aeppli | 330/2 |
| 4,036,445 | 7/1977 | Stutz et al. | 242/37 R |
| 4,045,659 | 8/1977 | Akagawa et al. | 364/470 |
| 4,169,399 | 10/1979 | Glockner et al. | 28/227 X |
| 4,184,769 | 1/1980 | Aeppli | 356/430 |
| 4,330,094 | 5/1982 | Mayer | 57/81 X |
| 4,924,406 | 5/1990 | Bergamini et al. | 73/160 X |
| 5,025,660 | 6/1991 | Heusser | 73/160X |
| 5,119,308 | 6/1992 | Samoto | 73/160 X |
| 5,124,928 | 6/1992 | Aemmer | 73/160 X |

FOREIGN PATENT DOCUMENTS

| | | | |
|---|---|---|---|
| 806872 | 2/1969 | Canada | 28/227 |
| 2280940 | 2/1976 | France . | |
| 2384231 | 10/1978 | France . | |
| 2515623 | 5/1983 | France . | |
| 2820097 | 2/1979 | Switzerland . | |
| 3237371 | 9/1983 | Switzerland . | |

OTHER PUBLICATIONS

The Modern Textile Dictionary by George E. Linton, New York, Duell, Sloan and Pearce; Little, Brown and Company.

Uster Polymatic, The Latest Generation Yarn Clearing System, Aug. 1981.

Uster Autosorter III, prior to Aug. 31, 1990.

Uster News Bulletin No. 29/Nov. 1981.

"Uster Polymatic-The Latest Generation Yarn Clearing System", Sep. 1987.

"Uster-Textile Electronics and Work Preparation", PE 474, pp. 1-34.

The Textile Institute Manual of Textile Technology, Evenness Testing in Yarn Poduction: Part II, R. Furter El Ing HTL Zellweger User AG,ISBN 0 900739 49 5, Quality Control Assessment Series, Copyright 1982, pp. 11-15 and 25-39.

*Primary Examiner*—Daniel P. Stodola
*Assistant Examiner*—William Stryjewski
*Attorney, Agent, or Firm*—Burns, Doane, Swecker & Mathis

[57] ABSTRACT

For the setting of yarn clearers for fineness control the number of permissible false alarms for a given yarn length, i.e. the permissible alarm frequency, is fixed. During the clearing process measured values of the fineness are recorded continuously, and their distribution is determined. From this distribution of the measured values and from the predetermined permissible alarm frequency, response limits are fixed independently on the basis of statistical regularities. Thus, the yarn clearers can be set automatically in an optimum manner on the basis of actual production circumstances, and mistakes between yarns differing only slightly in their fineness cannot occur.

17 Claims, 2 Drawing Sheets

METHOD FOR SETTING THE SENSITIVITY LIMITS OF ELECTRONIC YARN CLEARERS, AND DEVICE FOR CARRYING OUT THE METHOD

BACKGROUND OF THE INVENTION

The invention relates to a method for setting the sensitivity limits of electronic yarn clearers taking into account the fineness or count of the yarn to be cleared, the fineness being measured during the clearing process, and the result of this measurement being compared with set tolerance limits.

It is known (see, for example, USTER News Bulletin No. 29/August 1981 "Das Uster-System der Garnfehlerkontrolle" (The USTER System of Yarn Fault Control, USTER being a registered trademark of Zellweger Uster AG), the disclosure of which is hereby incorporated by reference in its entirety), that an essential precondition for accurate and reproducible yarn clearing is the establishment of a basic setting for the yarn batch to be cleared. As described in the USTER News Bulletin, yarn clearing ensures that yarn quality is suitable for subsequent processing by deleting and eliminating yarn faults. For example, typical yarn faults include deviations from a normal yarn cross-section which result in the occurrence of, for example, short thick places (e.g., a fault length of yarn less than 8 cm having a cross-section approximately twice that of the yarn), long thick places (e.g., a fault length greater than 40 cm having a cross-section approximately twice that of yarn), or thin places (e.g., having a variable fault length and a cross-section approximately 30 to 70% that of the yarn).

Although these yarn faults seldom occur, they can significantly affect the appearance of a fabric woven or processed from the yarn and/or negatively influence subsequent processing of the yarn. However, the number of faults which are actually eliminated over a given length of yarn is often limited to avoid subsequent processing difficulties. For example, as described in the aforementioned 1981 USTER News Bulletin, thin place faults thinner than 60% of normal yarn cross-section can be extracted when they are longer than approximately 40 cm, with faults shorter than 40 cm in length only being extracted if the cross-section is proportionately less than 60% of normal cross-section. Extraction of a maximum of 1–2 thin places per 100,000 cm of yarn is, for example, preferred for cotton spun yarns. Different settings can be provided for other faults, such as thick place faults and for different materials. Thus, the most important value which must be taken into account in establishing a basic setting for a yarn batch being cleared is the yarn count or fineness, which is used to fix the response limits (=tolerance values) which if exceeded give rise to a clearer step being triggered.

Since yarns of different fineness are normally spun in spinning mills, mistakes can occur, in particular in cases where the yarns differ only slightly in fineness from one another. However, even slight differences in the fineness lead to visible stripes in the woven or knitted fabric, making the product unusable. Yarn monitoring units, which measure the yarn fineness and trigger off an alarm or stop the production if the set tolerance limit is exceeded are available in order avoid this risk of confusion. However, every yarn naturally exhibits a certain unevenness, and since certain fineness deviations cannot be entirely avoided in the normal production process, difficulties are encountered in the setting of the response limits. For example, if the tolerance limits are set too narrow, false alarms frequently occur. On the other hand, if the tolerance limits are set too wide, not all faults which may be detected and eliminated without exceeding the number of correctable faults per unit length of yarn can be detected.

SUMMARY OF THE INVENTION

Therefore, an object of the present invention is, on the one hand, to eliminate the above-mentioned risk of confusion and, on the other, to permit an optimum setting of the response limits on the basis of actual production circumstances and to provide a simplified operation.

For the setting of the yarn clearer according to the invention, a number of false alarms permissible for a given yarn length, (i.e., the permissible alarm frequency) is fixed, and during the clearing process the measured values of the fineness are continuously recorded and their distribution is determined. From this distribution of the measured values and from the predetermined permissible alarm frequency the response limits are fixed independently on the basis of statistical regularities.

The process according to the invention therefore permits an automatic setting of the response limits, this setting being so optimized that only a predetermined number of false alarms occurs. Mistakes between yarns of different fineness are ruled out, and as an additional advantage, any tolerances which may occur in the control units are taken into account.

The invention also relates to a device for carrying out the above-mentioned process, having sensors for monitoring the yarn fineness, having actuators for initiating an operation triggered by the measuring signal of the sensor in question, and having a central signal processing stage to which the sensors and the actuators are connected.

The device according to the invention is characterized in that the central signal processing stage has a stage for statistical evaluation of the measuring signals of the sensors, an input stage for input of the permissible alarm frequency, and a stage for fixing the response limits.

BRIEF DESCRIPTION OF THE DRAWINGS

Other objects and advantages of the present invention will become more apparent from the following detailed description of preferred embodiments as described with reference to the drawings wherein.

DETAILED DESCRIPTION OF THE PREFERRED EMBODIMENTS

For the description which follows, electronic yarn clearing will be assumed to be known. In this connection reference is made to the already mentioned USTER News Bulletin No. 29/August 1981.

Figure 1:
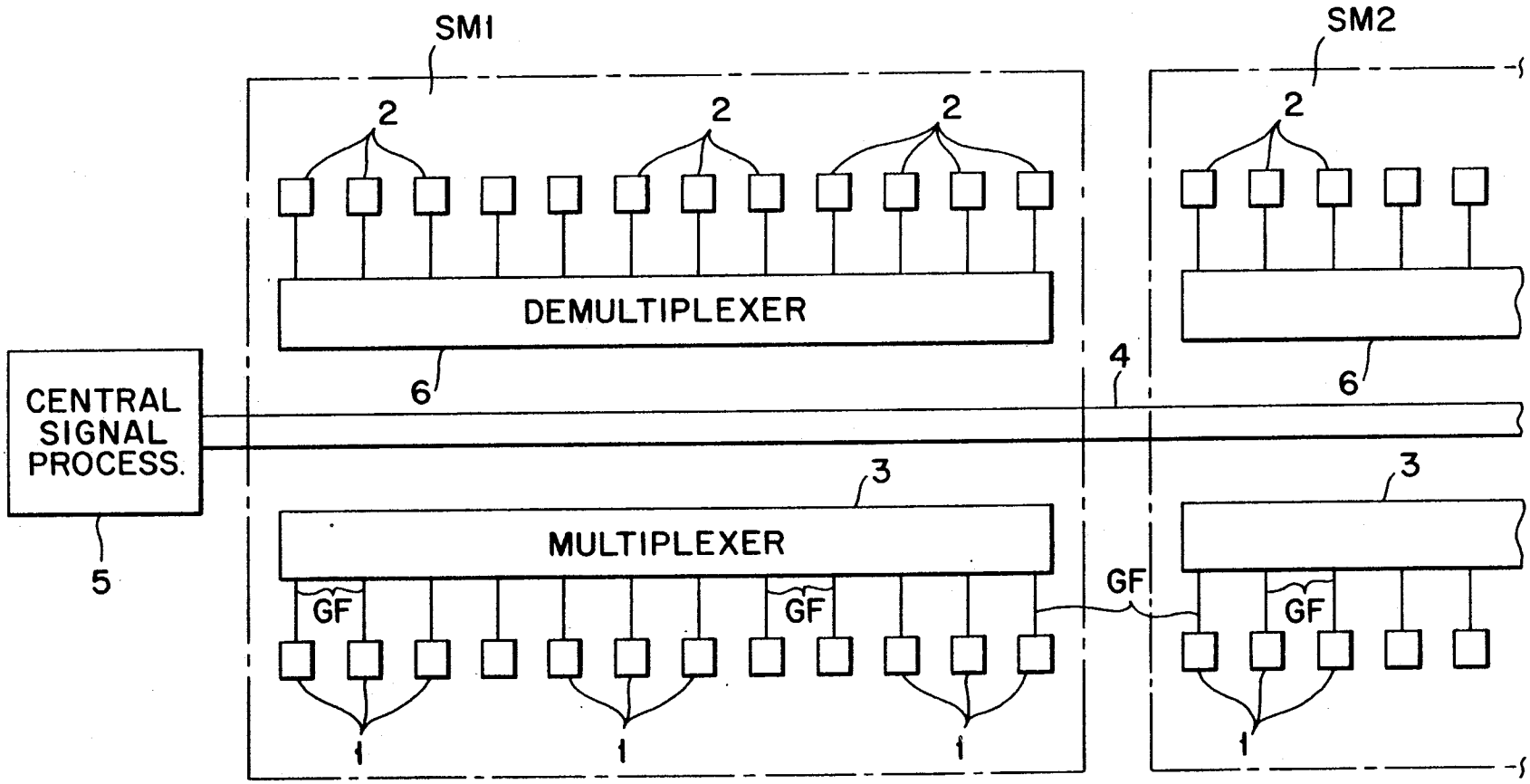
FIG. 1 shows a block diagram of a yarn clearing unit operating by the process according to the invention.

FIG. 1 shows a block diagram of a yarn clearing unit used on winders. Each of these winders has a number of winding points which are combined in sections, two of which, SM1 and SM2, are indicated symbolically in the figure. Each winding point is equipped with a sensor 1 for monitoring the yarn fineness and having a built-in cutting device to enable removal of detected defects in the yarn upon command. For this purpose, each winding point is further equipped with an actuator 2 for initiating an operation triggered by the measuring signal of the sensor 1 in question. For each sensor 1 and actuator 2, a thread or yarn is supplied which runs through the sensor and which is subsequently wound onto, for example, a conical cheese bobbin. The yarn fineness signals GF of the sensors 1 are fed by way of multiplexer 3 and a power line 4 to a central signal processing unit 5 such as the known USTER POLYMATIC central unit. The output signals of the central signal processing unit 5 reach the appropriate actuators 2 via the power line 4 and a demultiplexer 6.

Figure 2:
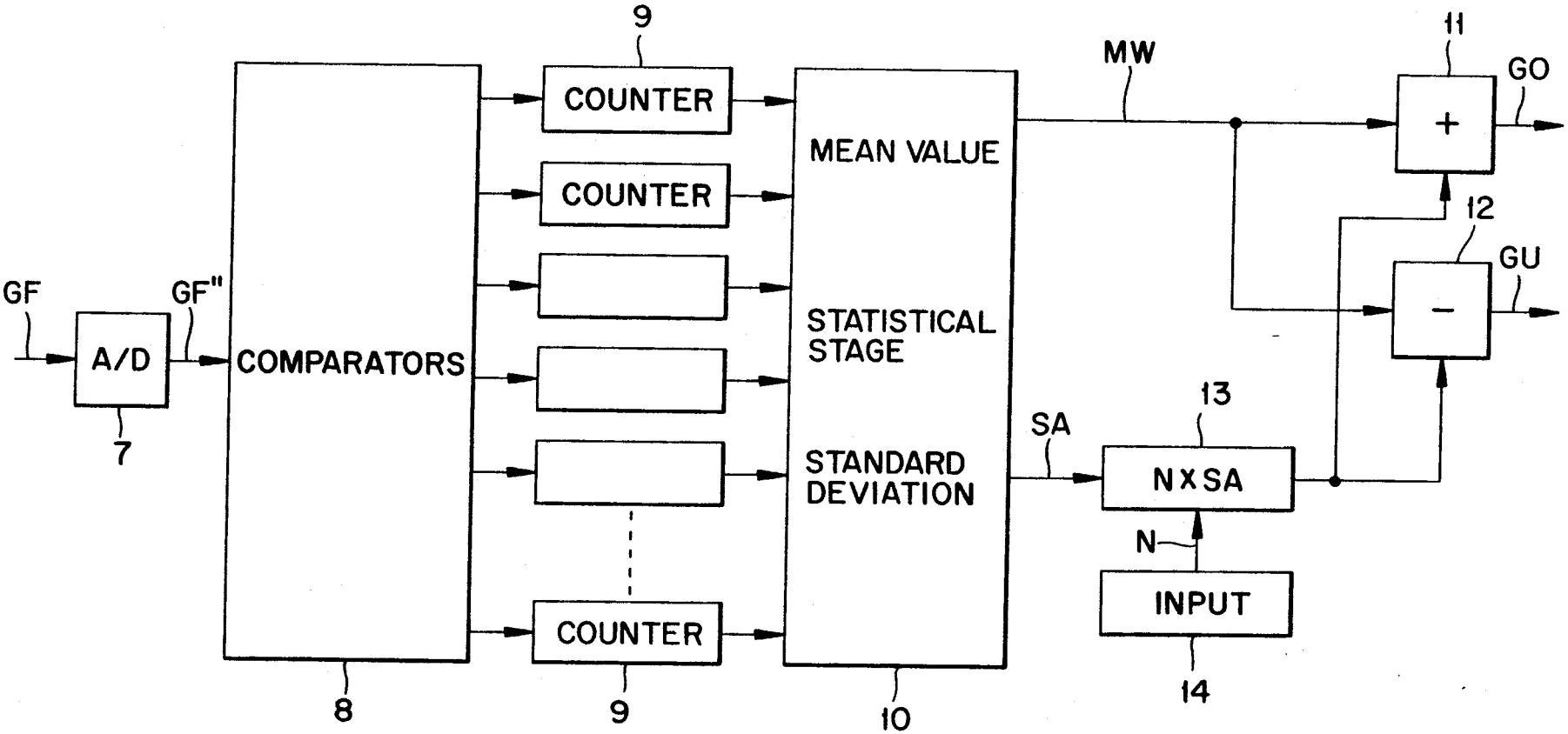
FIG. 2 shows a diagram to explain the process according to the invention for formation of the response limits.

The automatic formation of the response limits takes place in the central signal processing unit 5, of which a section with the individual function stages is shown in FIG. 2. As shown, the central signal processing unit 5 has an A/D converter 7, into which the yarn fineness signals GF of the sensors 1 (FIG. 1) go. The digitized yarn fineness signals GF* go into comparators 8, where they are compared with an upper and with a lower limit value.

For this purpose, a number of comparators 8 are provided according to the number of possible different yarn cross-sections to classify the yarn fineness detected at each sensor 1 into one of the different yarn cross-sections. The comparators thus establish within what limits the signal of each sensor 1 lies and then pass on the appropriate fineness signal to a counter allocated to the relevant cross-section class. In each of the counters 9 each signal received from one of the comparators 8 is counted as an event, so that the counter positions of all counters 9 establish a histogram of the fineness distribution of the threads of all winding points.

From this histogram, mean value and standard deviation are calculated by statistical methods in a statistics stage 10. The mean value MW thus calculated goes into an addition stage 11 or subtraction stage 12. The standard deviation SA goes to one input of a multiplication stage 13, at whose other input lies the output signal of an input stage 14 for the input of a variable N determining the permissible alarms per yarn length. A relationship derived on the basis of the usual product fluctuations exists between this variable N and the alarm frequency, assuming a normal distribution. This relationship is such than an alarm frequency of one per cent is represented by a value of 2.58 and an alarm frequency of one per mille is represented by a value of 3.29 for the variable N. The product N times SA, therefore corresponding to the alarm frequency times standard deviation, is thus formed in the multiplication stage 13. The output signal of the multiplication stage 13, the above-mentioned product, is now fed to the addition and subtraction stage 11, 12, the output signal of which indicates an upper and lower limit value GO and GU respectively of the fineness. These limit values are therefore obtained through addition or subtraction of the aforementioned product (i.e., N times standard deviation) and the mean value MW.

As soon as a fineness deviation exceeding or falling short of the limit values GO or GU is detected at a winding point by a sensor 1, the central signal processing unit 5 sends a signal to the demultiplexer 6. The latter triggers the appropriate actuator 2, as a result of which production at the winding point in question is stopped until the fault is eliminated.

As has already been mentioned, the response limits, i.e. the limit values GO and GU, are fixed independently on the basis of the measured fineness distribution and the predetermined permissible alarm frequency N. In this case measured values lying outside the alarm limits, i.e. those measured values leading to activation of the relevant activator 2, are not taken into account for the statistics.

Before an alarm limit is fixed, a certain number of basic measured values, for example 100, must be present. When the process described is used on a winder, these basic values are ascertained for each new cop or also after a thread breakage, i.e. on starting up or starting up again of the place of production. Mean value and standard deviation are then determined from these basic measured values.

The process described leads to an optimum automatic setting of the response limits on the basis of actual circumstances, while only a predetermined number of false alarms occurs and this number of false alarms forms the basis for setting of the response limits. The result is an optimum between faults which are left in the yarn and those which are removed and lead to production stoppages and disruptive knots.

The operation of a yarn monitoring unit in accordance with the present invention is extremely simple and monitoring for fineness faults is reliable, while any apparatus tolerances are also taken into account.

It is, of course, possible to embody the invention in other specific forms than those of the preferred embodiments described above. This may be done without departing from the essence of the invention. The preferred embodiments are merely illustrative and should not be considered restrictive in any way. The scope of the invention is embodied in the appended claims rather than in the preceding description and all variations and changes which fall within the range of the claims are intended to be embraced therein.

What is claimed is:

1. Process for setting the sensitivity limits of electronic yarn clearers taking into account the count of the yarn to be cleared comprising the steps of:

measuring the yarn count during a clearing process;

comparing the result of this measurement with set sensitivity limits, said set sensitivity limits being determined by setting the yarn clearer for a number of false alarms for a given yarn length represented as a fixed, predetermined alarm frequency limit, wherein said step of setting further includes the steps of:

continuously recording measured values of the yarn count during the clearing process and determining a yarn count distribution; and, automatically fixing said sensitivity limits independently in response to statistical interrelationships of the measured values and the predetermined alarm frequency limit.

2. Process according to claim 1, wherein said step of continuously recording further comprises the steps of:

comparing the measured values for the count with appropriate limit values to classify yarns on the basis of yarn cross-section classes; and, forming a histogram of a count distribution of checked yarns.

3. Process according to claim 2, wherein said step of automatically fixing further comprises the steps of:

calculating a mean value and a standard deviation from the histogram of the count distribution; and subsequently combining the mean value and standard deviation with the predetermined alarm frequency limit.

4. Process according to claim 3, wherein the standard deviation is multiplied by a variable representing the predetermined alarm frequency limit to form a product, and the sensitivity limits are formed through addition of the product of the multiplication with the mean value and subtraction of the product from the mean value.

5. Process according to claim 4, wherein measured values of the count lying outside the sensitivity limits are not taken into account in forming the histogram of the count distribution.

6. Process according to claim 5, further comprising the steps of:

re-recording measured values for count at each monitoring point at a start of production or after a production break; and, determining the sensitivity limits after a specific minimum number of measured values are present.

7. Apparatus for setting the sensitivity limits of electronic yarn clearers taking into account the count of the yarn to be cleared comprising:

sensors for monitoring yarn count and for producing yarn count measuring signals;

actuators associated with said sensors for initiating a yarn processing operation in response to comparison of a measuring signal from a respective one of the sensors relative to the sensitivity limits; and, a central signal processor to which the sensors and the actuators are connected, wherein the central signal processor further includes:

means for statistical evaluation of the measuring signals of the sensors;

means for inputting an alarm value representing an alarm frequency limit for the yarn clearers; and, means for automatically fixing the sensitivity limits independently based on statistical interrelationships of the yarn count measuring signals and the alarm frequency limit.

8. Apparatus according to claim 7, further comprising:

comparators for allocation of the measuring signals to different yarn cross-section classes; and, counters for counting the measuring signals falling in the different yarn cross-section classes.

9. Apparatus according to claim 8, wherein said central signal processor calculates a mean value and a standard deviation of a count distribution from the yarn count measuring signals counted by individual counters.

10. Apparatus according to claim 9, wherein the means for fixing the sensitivity limits further includes:

means for forming a multiplication product from the alarm value and the standard deviation; and, means for addition and subtraction of two inputs, the mean value of the count distribution always being present at one input of both the addition and subtraction means and the product being present at the other input of both the addition and subtraction means.

11. Apparatus for clearing yarn at yarn winding points of yarn winders comprising:

a plurality of sensors for monitoring yarn count at respective yarn winding points, each of said sensors providing a yarn count measuring signal;

a plurality of actuators associated with said plurality of yarn count sensors for initiating winding stoppage at said winding points in response to said yarn count measuring signals; and, a signal processor connected to said plurality of sensors and said plurality of actuators for statistically evaluating said yarn count measuring signals and for controlling said plurality of actuators, said processor further including:

means for inputting a predetermined alarm frequency signal for yarn clearing; and, means for automatically fixing tolerance limits used to control said actuators in response to the statistical evaluation and the predetermined alarm frequency.

12. Process for automatically setting tolerance limit values used to trigger a yarn clearing step in an electronic yarn clearer, said process comprising the steps of:

inputting a predetermined alarm frequency representing a number of yarn faults tolerated over a given yarn length in the yarn clearing unit;

measuring a yarn count for yarns located at plural winding points of the yarn clearing unit;

classifying the yarns measured at each winding point to establish a yarn count histogram for the yarns measured at the winding points.

calculating a mean value and standard deviation for said yarn count histogram;

automatically setting the tolerance limit values in response to the predetermined alarm frequency, the mean value and the standard deviation; and triggering a yarn cleaning operation when measured yarns located at ny of said plural winding point fall outside the set tolerance limit values.

13. Process according to claim 12, wherein said step of automatically setting further includes steps of:

multiplying the standard deviation by the predetermined alarm frequency to obtain a multiplication product; and obtaining at least two tolerance limit values by adding and subtracting the multiplication product and the mean value.

14. Process according to claim 12, wherein said step of classifying further includes the step of:

establishing the yarn count histogram using a predetermined number of measured yarn values prior to said step of calculating.

15. Process for setting sensitivity limits used to trigger a yarn cleaning step in an electronic yarn clearer, comprising the steps of:

inputting a predetermined alarm frequency representing a maximum number yarn fault clearing operations for a given yarn length;

measuring yarns being cleared by the electronic yarn clearing apparatus at plural yarn winding points and continuously classifying the yarn measurements as to yarn count to establish a yarn count histogram for the measured yarns; and automatically setting the sensitivity limits in response to the predetermined alarm frequency and in response to statistical characteristics of the yarn count histogram.

16. Process according to claim 15 further including a step of:

triggering a yarn clearing operation using the sensitivity limit.

17. Process according to claim 16, wherein said step of automatically setting further includes steps of:

calculating a mean value and standard deviation for said yarn count histogram;

multiplying the standard deviation by the predetermined alarm frequency to obtain a multiplication product; and obtaining at least two sensitivity limit values by adding and subtracting the multiplication product and the mean value.

* * * * *